United States Patent [19]

Altman Robbins et al.

[11] Patent Number: 4,825,572

[45] Date of Patent: May 2, 1989

[54] TEMPORARY PHOTO STAND

[76] Inventors: Clara J. Altman Robbins, 5000 Town Center, Apt. 204, Southfield, Mich. 48075; Steven J. Krasnick, 26725 Hendri Blvd., Huntington Woods, Mich. 48070

[21] Appl. No.: 195,360

[22] Filed: May 12, 1988

Related U.S. Application Data

[63] Continuation of Ser. No. 885,310, Jul. 14, 1986, abandoned.

[51] Int. Cl.[4] ..... G09F 1/12

[52] U.S. Cl. ..... 40/152.1; 40/539; 40/155

[58] Field of Search ..... 40/124.1, 152.1, 539, 40/155

[56] References Cited

U.S. PATENT DOCUMENTS

| | | | |
|---|---|---|---|
| 759,946 | 5/1904 | Webber | 40/152.1 |
| 1,524,338 | 1/1925 | Chesney | 40/152.1 |
| 2,115,448 | 4/1938 | Pradt | 40/152.1 |
| 3,624,688 | 11/1971 | Miller | 40/152.1 |
| 4,213,259 | 7/1980 | Coda | 40/152.1 |
| 4,425,394 | 1/1984 | Jenkins | 40/2 R |

FOREIGN PATENT DOCUMENTS

| | | | |
|---|---|---|---|
| 625554 | 8/1947 | United Kingdom | 40/152.1 |

OTHER PUBLICATIONS

Physics by Semat and Katz, ©1958, p. 50.

*Primary Examiner*—Henry E. Raduazo
*Attorney, Agent, or Firm*—Krass & Young

[57] ABSTRACT

A low cost temporary photograph stand consisting of a rectangular strip of foldable sheet material such as paper or cardboard, folded into a generally triangular configuration with a low tack adhesive coating in the outer surface of one side of the stand for temporarily fastening the stand to the back of a photograph for display without damage to the photograph.

1 Claim, 4 Drawing Sheets

PADULAR FORM

TEMPORARY PHOTO STAND

This is a continuation of application Ser. No. 885,310, filed on July 14, 1986, and now abandoned.

BACKGROUND OF THE INVENTION

1. Field of the Invention

This invention relates to a low cost temporary stand for photographs, and more particularly, to such a stand which may be formed by folding imprinted sheets having adhesive coatings on sections thereof.

2. Description of the Related Art

A wide variety of frames and associated stands are available for the display of photographs. These frames are generally intended for permanent use and are relatively expensive and heavy. A need exists for a low cost stand which can be packaged with and easily attached to photographs when they are received from photo-finishers, to allow temporary display of the photographs until they may be more permanently mounted in albums or permanent frames.

SUMMARY OF THE INVENTION

The present invention is directed toward a temporary, low cost photograph stand consisting of an elongated rectangular strip of sheet material, such as heavy paper, cardboard, or plastic, folded into a triangular configuratioon and having a low tack adhesive coated on the outer surface of one side of the triangle so that that surface may be secured to the back of a photograph and may later be removed from the photograph without damaging the surface.

The stands of the present invention are intended to be supplied with finished photographs by the photofinishers. When the photographs are viewed some of them may be selected for attachment to the stands so they may be temporarily displayed on a table or the like. The stands are preferably supplied in the form of a sheet which is divided by perforations into a number of separate strips each of which may be torn off to form separate stands. The sheet preferably has fold lines imprinted thereon at right angles to the perforations. One portion of each of the sections formed thereby is coated with a low tack adhesive which may be used to join the ends of a strip separated from the sheet into the desired triangular form and also to secure one surface of the triangular support to the back of the photograph.

Alternatively the strips of sheet material from which stands may be formed are joined together in a pad form, eliminating the need for tearing one sheet off the larger sheet.

The stands of the present invention are sufficiently inexpensive so that a photofinisher may include a number of stands in an envelope with developed prints as a promotional scheme. The stands are easy to form and when they are removed from the photograph they may be discarded. These and other features and advantages of the invention will become apparent following the detailed description of the preferred embodiments of the invention.

DETAILED DESCRIPTION OF THE PREFERRED EMBODIMENT

The photo stand, broadly considered, includes a continuous strip of foldable elongated sheet material 10, transverse fold lines 20 which separate the sheet material into several distinct portions 30, 40, 50 and 60 respectively, and a low pressure sensative adhesive 70.

Figure 1:
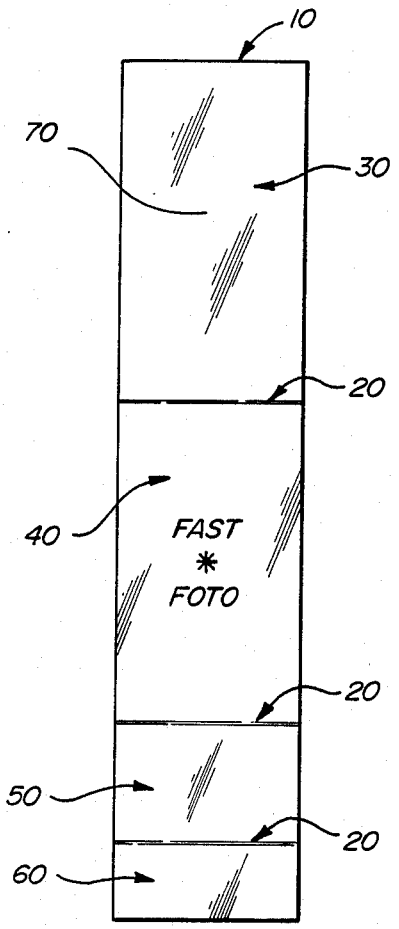
FIG. 1 is a top view of the invention photo stand.
Figure 2:
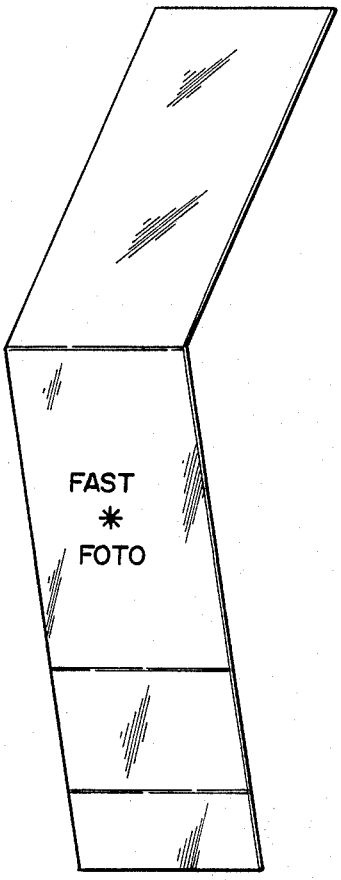
FIGS. 2–4 are isometric views showing successive steps in the formation of the photo stand assembly.
Figure 3:
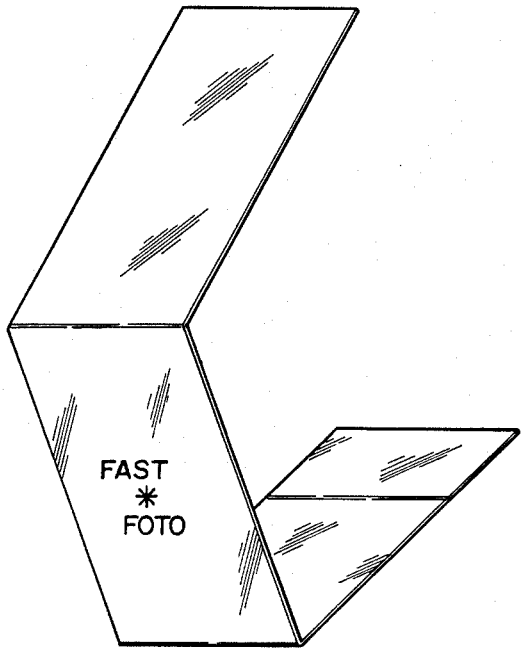
Figure 4:
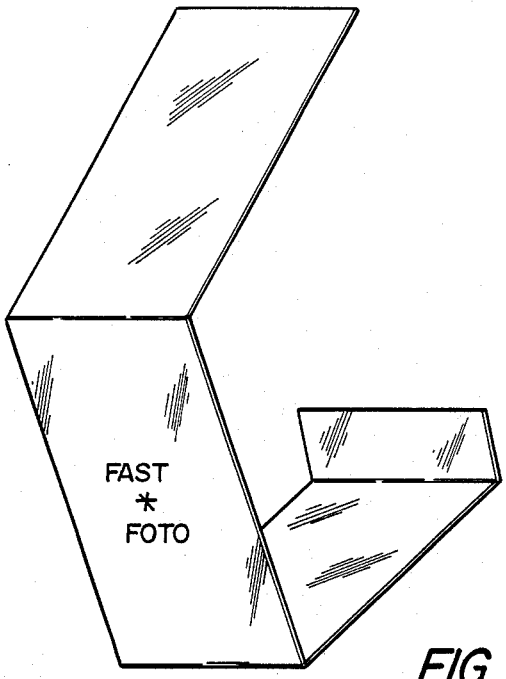

Sheet material 10, as seen in FIG. 1, is formed of a continuous and flexible material. Transverse fold lines 20 are printed on the sheet material 10 forming the distinct portions which are folded relative to each other to form the photo stand assembly. Low pressure sensative adhesive 70 is applied to the top side of portion 30 and used to assemble the photo stand and fasten it to the respective photograph.

Figure 5:
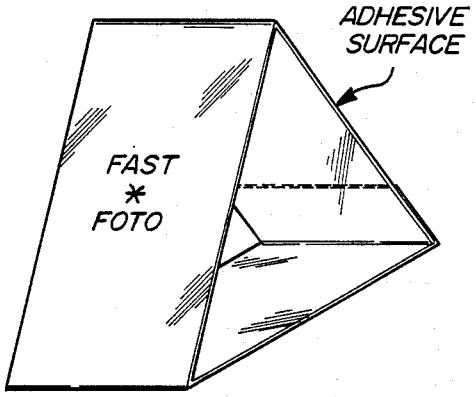
FIG. 5 is an isometric view of the completed photo stand.

The completed assembly best shown in FIG. 5, forms a triangular stand which is ten attached as a supporting base to the photograph.

Figure 6:
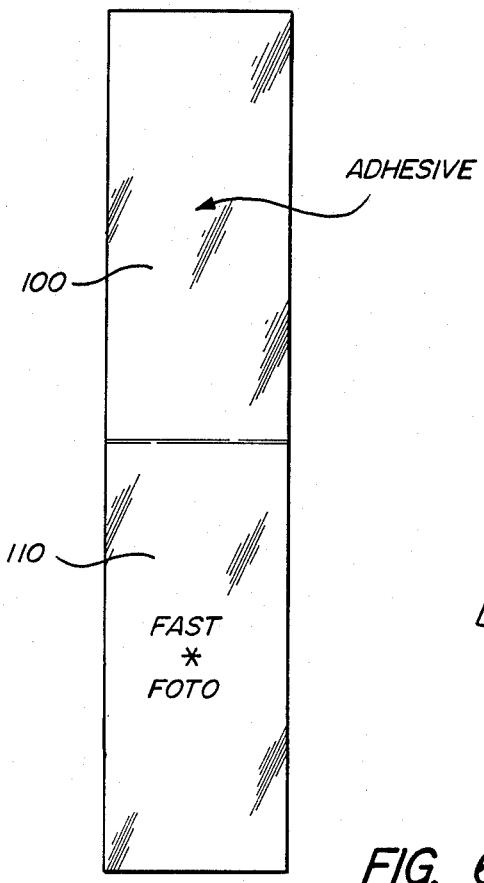
FIG. 6 is a top view of an alternative embodiment of the invention photo stand.
Figure 7:
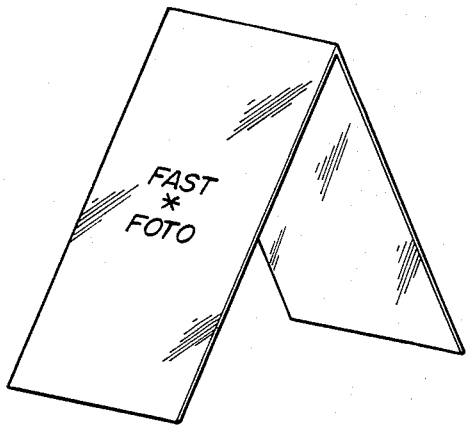
FIG. 7 is an isometric view of the alternative embodiment of the invention if FIG. 6.

In an alternative embodiment of FIG. 6, the elongated sheet material contains one transverse fold line which is used to separate the sheet materialk into two distinct portions 100 and 110. A low pressure-sensitive adhesive is applied to the top surface of portion 100 which is then used to attach the completed stand to the respective photograph best shown in FIG. 7.

Figure 8:
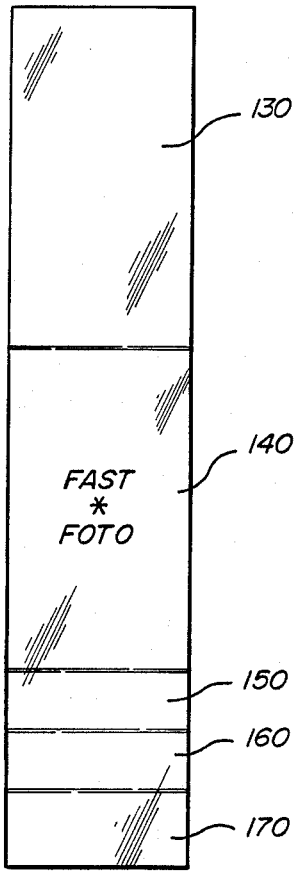
FIG. 8 is a top view of an additional alternative embodiment of the invention photo stand.
Figure 9:
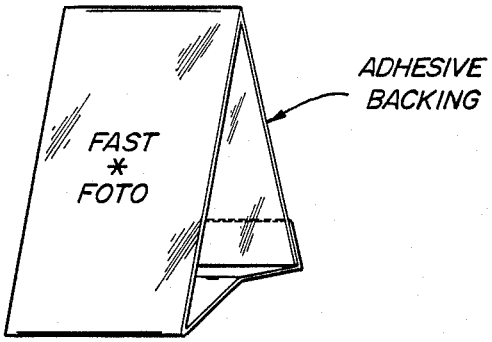
FIG. 9 is an isometric view of the completed additional alternative embodiment.
Figure 11:
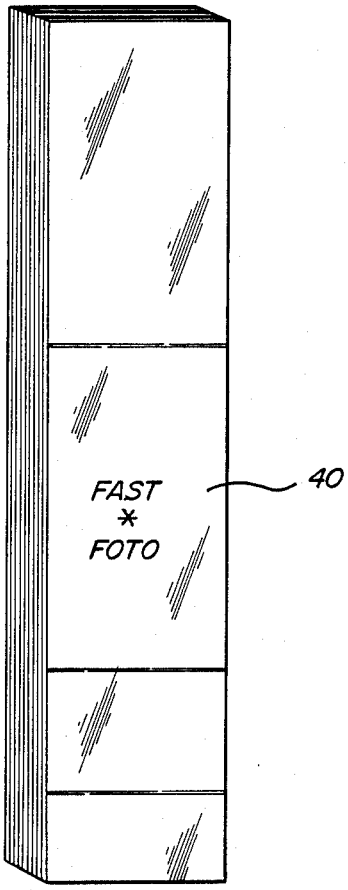
FIG. 11 is an isometric view of the padularly packaged strips of sheet material.
Figure 10:
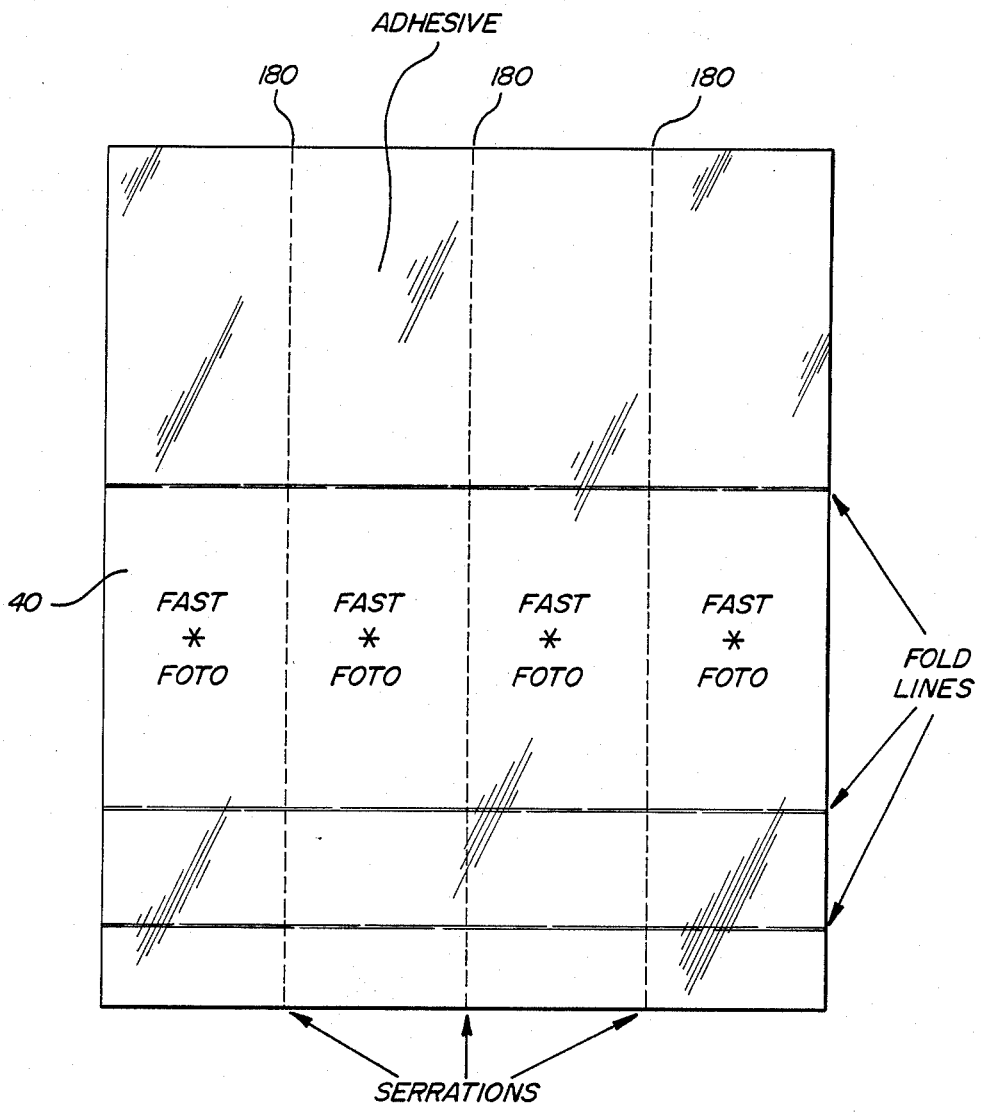
FIG. 10 is a top view of coplanarly packaged sheet matierals.

In an additional preferred embodiment of FIG. 8, the foldable elongated sheet material contains five transverse fold lines which separagte the sheet into five distinct portions 130, 140, 150, 160 and 170. A low pressure-sensitive adhesive is applied to the top of portion 130 which is then used to fasten the photo assembly together and to the respective photograph. The addition of the extra portion 160 provides for a stronger and arcuatly shaped base best shown in an isometric view of the completed photo stand of FIG. 9. The strips of sheet materials may be packaged in a variety of ways. As shown in FIG. 10, they may be coplanarly packaged and separated by longitudinal perforations 180. Additionalloy, the strips of sheet material may be packaged in a padular form as shown in FIG. 11. Photo finishers would most likely apply a form of advertisement on mid-portion 40 of each individual sheet strips.

We claim:

1. A plurality of rectangular, elongated, strips of foldable sheet material secured to one another to form a sheet, each strip having three spaced transverse fold lines separating said strip into four longitudinally contiguous sections, the section at one end of the strip being of a lesser longitudinal extent than the section at the opposite end of the strip, and a coating of pressure-sensitive adhesive formed on and extending along the longitudinal axis of one surface of the longer of said end sections for a length longer than the longitudinal extent of said opposite end section, each strip being adapted to be removed from said sheet and folded into a triangular section with the shorter of said end sections secured to the end section having the pressure-sensitive adhesive coating thereon to form a triangular stand which may be secured to the rear of a photograph of the like by the uncovered portion of said pressure-sensitive adhesive.

* * * * *